US007621159B2

(12) United States Patent
Siig

(10) Patent No.: US 7,621,159 B2
(45) Date of Patent: Nov. 24, 2009

(54) METHOD AND APPARATUS FOR FASTENING FUR ON A PELTING BOARD AND WINDING MATERIAL THEREFOR

(75) Inventor: Peter Siig, Ans By (DK)

(73) Assignee: 4M Globe Management Ltd, London ( * ) Notice: Subject to any disclaimer, the term of this patent is extended or adjusted under 35 U.S.C. 154(b) by 0 days.

(21) Appl. No.: 10/590,478

(22) PCT Filed: Feb. 23, 2005

(86) PCT No.: PCT/DK2005/000120

§ 371 (c)(1),
(2), (4) Date: Jun. 21, 2007

(87) PCT Pub. No.: WO2005/080607

PCT Pub. Date: Sep. 1, 2005

(65) Prior Publication Data

US 2007/0277564 A1 Dec. 6, 2007

(30) Foreign Application Priority Data

Feb. 24, 2004 (DK) ..... 2004 00290

(51) Int. Cl.
*C14B 1/58* (2006.01)

(52) U.S. Cl. ..... 69/22; 69/19.1

(58) Field of Classification Search ..... 69/19, 69/19.1, 19.3, 22, 23, 27
See application file for complete search history.

(56) References Cited

U.S. PATENT DOCUMENTS

| | | | | |
|---|---|---|---|---|
| 2,231,903 | A | 2/1941 | Graham | |
| 2,232,885 | A * | 2/1941 | Philbrick | 69/19.2 |
| 2,942,448 | A * | 6/1960 | Jonas | 69/46 |
| 3,204,435 | A | 9/1965 | Olson | |
| 4,346,550 | A * | 8/1982 | Ferree | 57/10 |
| 4,461,429 | A * | 7/1984 | Goekler et al. | 242/439.5 |
| 5,564,293 | A | 10/1996 | Black et al. | |
| 6,490,852 | B1 * | 12/2002 | Mustacich et al. | 57/3 |
| 6,701,756 | B2 * | 3/2004 | Hedegaard | 69/22 |
| 2003/0019255 | A1 | 1/2003 | Hedegaard | |
| 2004/0060330 | A1 | 4/2004 | Hedegaard | |

FOREIGN PATENT DOCUMENTS

| | | | |
|---|---|---|---|
| DK | 172960 | B1 | 8/1995 |
| GB | 2211203 | A * | 6/1989 |
| WO | WO 01/62985 | | 8/2001 |

* cited by examiner

*Primary Examiner*—Shaun R Hurley
(74) *Attorney, Agent, or Firm*—Antonelli, Terry, Stout & Kraus, LLP.

(57) ABSTRACT

The present invention is a method for fixing a fur on a pelting board (6) which is temporarily held in a pelting board holder (2), where the fur is put on the pelting board (6), where end parts of the fur are retained in a fur holder (3), and where the fur is stretched on the pelting board (6) to a desired length. Preferably the end part of the fur is fixed on the pelting board (6) by winding with a winding material (13), such as a band. The invention further is an apparatus (1) for securing a fur on a pelting board (6), where the apparatus (1) includes a pelting board holder (2), a fur holder (3) and a band winding unit (4), and where the band winding unit (4) is arranged for moving around the pelting board holder (2).

26 Claims, 3 Drawing Sheets

METHOD AND APPARATUS FOR FASTENING FUR ON A PELTING BOARD AND WINDING MATERIAL THEREFOR

BACKGROUND OF THE INVENTION

1. Field of the Invention

The present invention concerns a method for securing a fur on a pelting board which is temporarily fastened in a pelting board holder, where the fur is put on the pelting board, where end parts of the fur are retained in a fur holder, and where the fur is stretched on the pelting board to a desired length.

The invention furthermore concerns an apparatus for fixing a fur on a pelting board according to the above method.

2. Description of the Prior Art

During treatment, a fur is put on a pelting board in order that the fur may be dried and stretched to the desired length, after which the fur is ready for storage and selling.

It is important that the fur is stretched to a certain length, as the length of the fur determines the price the fur farmer can obtain for the fur at an auction.

When the fur is put on a pelting board and stretched, it is important to fix the fur to the pelting board so that the fur keeps the desired length during and after drying.

The fixing may be done in different ways, for example:

Staples are used which are shot through a lower end part of the fur and into the pelting board. However, this has the disadvantage of holes being produced in the fur, reducing the quality and the number of applications of the fur.

Cover bags with holes are used where the cover bag is provided with an elastic lower edge squeezing around a lower end part of the fur. However, this has the disadvantage that the lower elastic edge has to be very strong in order to produce a squeezing force large enough to fix the fur on the pelting board, causing increased expenses for making the cover bag.

Cover bags with holes are used, where the cover bag may be provided with a lower edge which is crimped by heat. However, this has the disadvantage that the lower edge has to be made of a material that may endure a strong heating while at the same time the heating of the lower edge of the cover bag may damage the fur side of the fur. This will cause the fur to be depreciated in quality, and that a heating process has to be established in the drying phase, a fact which may increase the costs of treating the fur.

A combination of the above possibilities may be applied.

Furthermore, it is to be noted that, for example, a cover bag deformed at the lower edge, either by heat crimping or by using staples, can only be used once, entailing a continuing expense for cover bags and a large amount of waste to be removed by fur farmers.

An advantage of using a cover bag is, however, that possible fat residues sitting on the fur side of the fur are sucked into the cover bag during the drying process and is removed when the cover bag is pulled off the fur/pelting board. By thorough cleaning of the fur side of the fur before the drying process, the advantage of using cover bags is considerably reduced.

SUMMARY OF THE INVENTION

The present invention is a method for fixing a fur on a pelting board, where the fixing occurs in a simple and easy way without damaging the quality of the fur.

This is achieved by a method where the end part of the fur is fixed on the pelting board by winding with a winding material such as a band.

The invention is an apparatus that may fix at least an end part of a fur in a simple and easy way without damaging the fur.

This is achieved with an apparatus where the apparatus comprising a pelting board holder, a fur holder and a band winding unit, and where the band winding unit is adapted to move around the pelting board holder.

After skinning a fur animal and scraping and turning the fur, the fur has to be cleaned, dried and possibly softened before it can be sold.

The drying process occurs by the fur being put on a pelting board, after which air is blown through the fur. In order to ensure that the fur remains on the pelting board during the drying process, it is important that at least part of the fur becomes fixed to the pelting board, so that air does not loosen the fur from the pelting board and the fur dries in wrong shape.

In order to prevent the dried fur from having the incorrect shape after the drying process, the pelting board is designed with the desired shape, which is typically a board where the width increases downwards.

Since the fur farmer, as mentioned, is rewarded for producing long furs, it is important that the fur is stretched to the desired length. The fur is therefore put on a pelting board which is temporarily fastened in a pelting board holder, and where an end part of the fur is retained in a fur holder gripping the end part and pulling the fur in the longitudinal direction of the pelting board, until the fur attains a desired length.

In order to ensure that the fur keeps this length during the drying process, the fur has to be fixed to the pelting board, which according to the present invention is achieved in that preferably the end part of the fur is fixed on the pelting board by winding with a winding material, such as a band.

The winding material is wound tightly around the end part so that the fur is prevented from creeping back to the original length.

By using a winding material for fixing the fur where the winding material is only wound around an end part of the fur, an optimal air flow through the fur is ensured, and the drying process can be performed rapidly and less expensively, as the same amount of air, or air with high temperature, is not required for achieving a satisfactory result.

In order to perform winding a winding material around an end part of the fur, the present invention is an apparatus which includes a pelting board holder, a fur holder and a band winding unit, and where the band winding unit is arranged for moving around the pelting board holder.

The pelting board is held temporarily in the pelting board holder while the fur is stretched to desired length, and while the winding material is wound about an end part of the fur, so that it becomes fixed to the pelting board, after which the pelting board with the fur is released from the pelting board holder and put into a drying stand and moved into a drying chamber or through which air is blown.

In order to stretch the fur to desired length, the apparatus is provided with a fur holder that grips the fur and stretches the fur in the longitudinal direction of the pelting board, so that the fur bears against the pelting board and thereby achieves the same shape as the pelting board which is shaped as a staff with increasing width.

In order to wind the winding material around an end part of the fur, the apparatus is provided with a band winding unit which is arranged to move around the pelting board holder, whereby the winding material is unrolled and is wound on the pelting board with the fur, and thereby a part of the fur is fixed to the pelting board.

The winding material will typically be wound around the end part of the fur disposed at the broad end of the pelting board, so that it is ensured that the entire fur is kept extended during the drying process.

In order that the winding material can be unrolled and subsequently wound around the end part of the fur, the band winding unit includes a supply reel which is arranged on a guide ring of the band winding unit.

The winding material is, for example, a band which is rolled up on the supply reel, so that there is sufficient winding material on the supply reel for winding a large number of furs.

The supply reel is arranged on a guide ring, which in a preferred embodiment of the present invention surrounds the pelting board and may rotate, causing the supply reel with the winding material to move around the pelting board with the fur.

The guide ring is rotated by means of a motor which is drivingly connected with the guide ring via drive wheels that have a side part engaging a side part of the guide ring.

In order to ensure stable rotation of the guide ring, there are guide wheels in addition to the drive wheels and which, just like the drive wheels, have a side part engaging a side part of the guide ring.

The winding of the winding material is accomplished by the winding material is pressed inwards against the fur, after which the guide ring initiates its rotation, whereby the supply reel is moved around the pelting board, and the winding material is unrolled from the supply reel and is wound around upon the fur.

Locking of the first layer of winding material is effected by at least the next layer of the winding material being wound tightly around the first layer of winding material. A secure locking of winding material typically occurs by repeated winding with winding material on underlying winding material.

As a large squeezing force is needed for fixing the end part of the fur to the pelting board and to prevent the fur from contracting again, the supply reel is provided with a brake, for example, a friction brake, which provides for holding the winding material tight all the time while winding it around the fur.

The brake may furthermore be used when the winding of the winding material is to stop, as locking of the supply reel simultaneously with continued rotation of the guide ring causes the winding material to be stretched and thereby locked on itself, after which the winding material may be cut, or alternatively broken by continued rotation of the guide ring.

In an alternative embodiment of the present invention, the band winding unit is displaceably arranged in relation to the pelting board holder and in the longitudinal direction of the pelting board. This means that it is possible after a first fixing of a lower end part of the fur to move the band winding unit along the length of the pelting board, whereby other parts of the fur, for example, the tail of the fur, are fixed to the pelting board, whereby there is achieved a better fixing of the fur to the pelting board and great reduction of the risk of loosely hanging parts of the pelting board becoming wound into other furs or torn off or damaged in succeeding treating processes.

The fur holder is adapted to interact with the pelting board holder in order to stretch the fur to the desired length. Therefore the fur holder is arranged displaceably in relation to the pelting board holder and in the longitudinal direction of the pelting board, so that when the pelting board is secured in the pelting board holder, the pelting board holder stays in a stationary position while the fur holder is moved in the longitudinal direction of the pelting board, and thereby an attached fur is stretched beyond the pelting board.

In order to ensure that the fur is stretched down around the pelting board, the lower end part of the fur is gripped and pulled downwards so that the fur is made longer and adapts to the shape of the pelting board. In order to grip the lower end part of the fur, the fur holder includes a number of grippers for securing the fur.

These grippers are disposed at both sides of the pelting board holder and are typically disposed in pairs, so that a uniform downwards pull on the fur is achieved, whereby there may be achieved the greatest increase in length and the most uniform shape, simultaneously with the quality of the fur being maintained.

In order to ensure that the winding material may fix the fur on the pelting board during the entire drying process, the winding material is constituted by an elastic winding material with the ability to lock on itself in stretched condition.

As the winding material only will have a locking action when in contact with itself, it will not damage the fur side of the fur by adherence to the fur side and thereby increase the risk of a single fur hair being ripped off when the winding material is removed, and thereby destroy the fur side of the fur.

As the winding material may lock on itself in stretched condition, it is possible to fix a fur on a pelting board by winding the winding material at least once around the pelting board and then stretch the last layer of the winding material down against an underlying layer, whereby the two layers interlock, and it is possible to sever/shear the winding material.

In order to ensure efficient fixing of the fur, the winding material is typically wound around the pelting board at least twice.

As the winding material only locks on itself in stretched condition and does not adhere to the fur side or other surfaces, it is easy to remove the winding material when the fur is dried and taken off the pelting board. The winding material may, for example, be severed or torn without damaging the fur.

In an alternative embodiment of the present invention, the winding material comprises a stretchable winding material and a fixing means, where the winding material is wound preferably tightly and at least once around the pelting board, and the fixing means retains the winding material. In order to remove the stretchable winding material, either the fixing means is removed or the stretchable winding material is broken.

For example, the fixing means may be constituted by tape or glue that secures an end part of the stretchable winding material down against an underlying layer of the stretchable winding material.

The elastic winding material is, for example, a band, a film or the like having a width greater than the thickness of the winding material. The width may vary between 2 mm and 1000 mm, and typically there will be applied winding material with a width between 30 and 70 mm.

The stretchable winding material is, for example, a band, a cord or the like having a width enabling fixing of the first layer of the winding material by winding several layers of the winding material.

Alternatives to an elastic and/or stretchable winding material are, for example, strips or Velcro-bands, whereby the fur becomes fixed to the pelting board during the succeeding treating processes, and the fur may readily be released from the pelting board again.

The apparatus may be fully automatic so that the entire process, right from securing the pelting board in the pelting board holder and winding the winding material around the fur, occurs in a continuous process.

Alternatively, the apparatus can be operated manually, so that one person may activate the various subprocesses, as for example:

mounting the pelting board in the pelting board holder;

extending the fur with the fur holder; and winding the winding winding material.

The apparatus may be used for any kind of fur animal, where the fur is put on a pelting board for drying, the fur animal, for example, being a mink, a fox, a sable, a marten or the like.

BRIEF DESCRIPTION OF THE DRAWINGS

The invention will now be explained more closely with reference to the accompanying drawing, where.

DETAILED DESCRIPTION OF THE INVENTION

Figure 1:
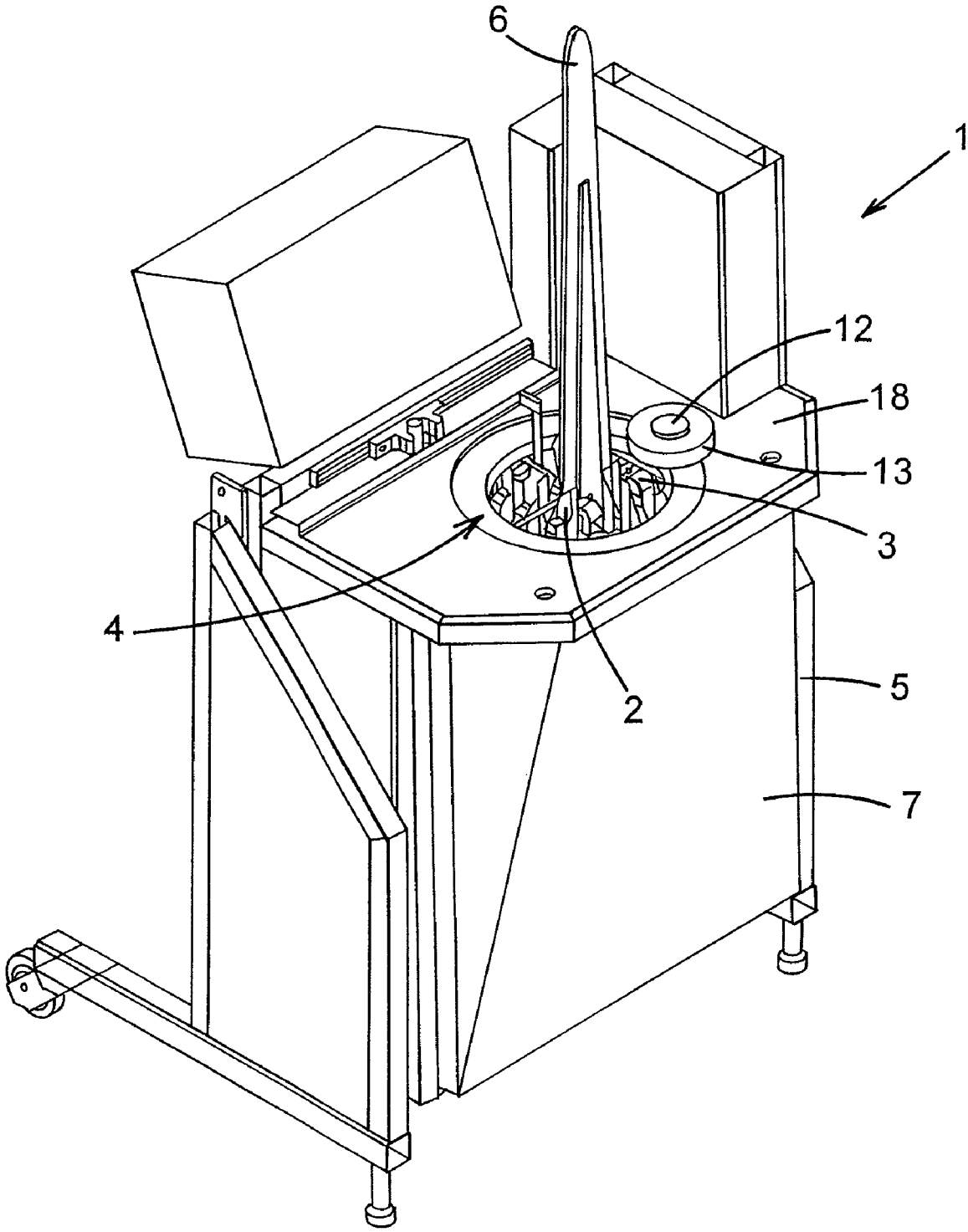
FIG. 1 shows an apparatus according to the invention.

FIG. 1 shows an apparatus 1 that includes a pelting board holder 2, a fur holder 3 and a band winding unit 4 mounted in a frame 5 that elevates the apparatus 1 to an appropriate working level. A pelting board 6 is shown secured in the pelting board holder 2. The rotating parts of the band winding unit 4 are guarded with a guard 7 and a table top 18, whereby it is safe for a person (not shown) to stand at the apparatus 1 and operate it.

Figure 2:
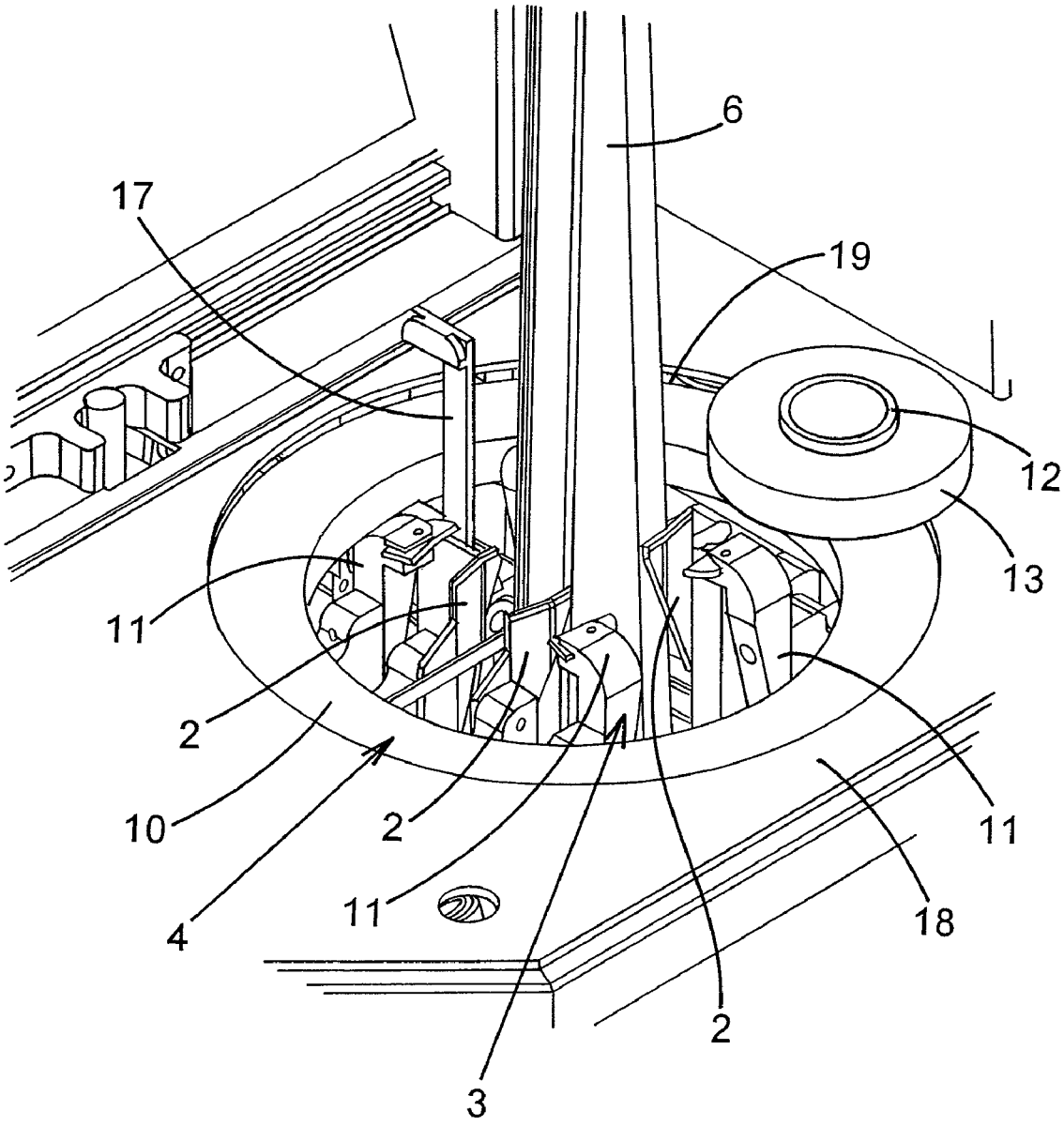
FIG. 2 shows a close-up view of the apparatus.

FIG. 2 shows how a pelting board 6 is secured by the pelting board holder 2, and that the fur holder 3 is provided with a number of grippers 11 for fixing a fur (not shown) to the pelting board 6. The band winding unit 4 is covered by the table top 18 so that an opening 19 admits access to the pelting board holder 2 and the fur holder 3 which is surrounded by a guide ring 10, on which there is provided a supply reel 12 with a winding material 13. Associated with the opening 19 pelting board holder 2 and fur holder 3 there is provided a holding device 17 used in winding the winding material 13.

The holding device 17 is arranged stationarily in relation to the guide ring 10 but may be displaced in longitudinal direction of the pelting board, so that the holding device 17 in a first position allows insertion of an end part of the winding material 13, while in a second lowered position it allows retention of the winding material 13 and simultaneously allows the supply reel 12 to pass by the holding device 17. The holding device 17 may be designed with a cutting unit in the shape of a pair of scissors, a knife or similar.

Figure 3:
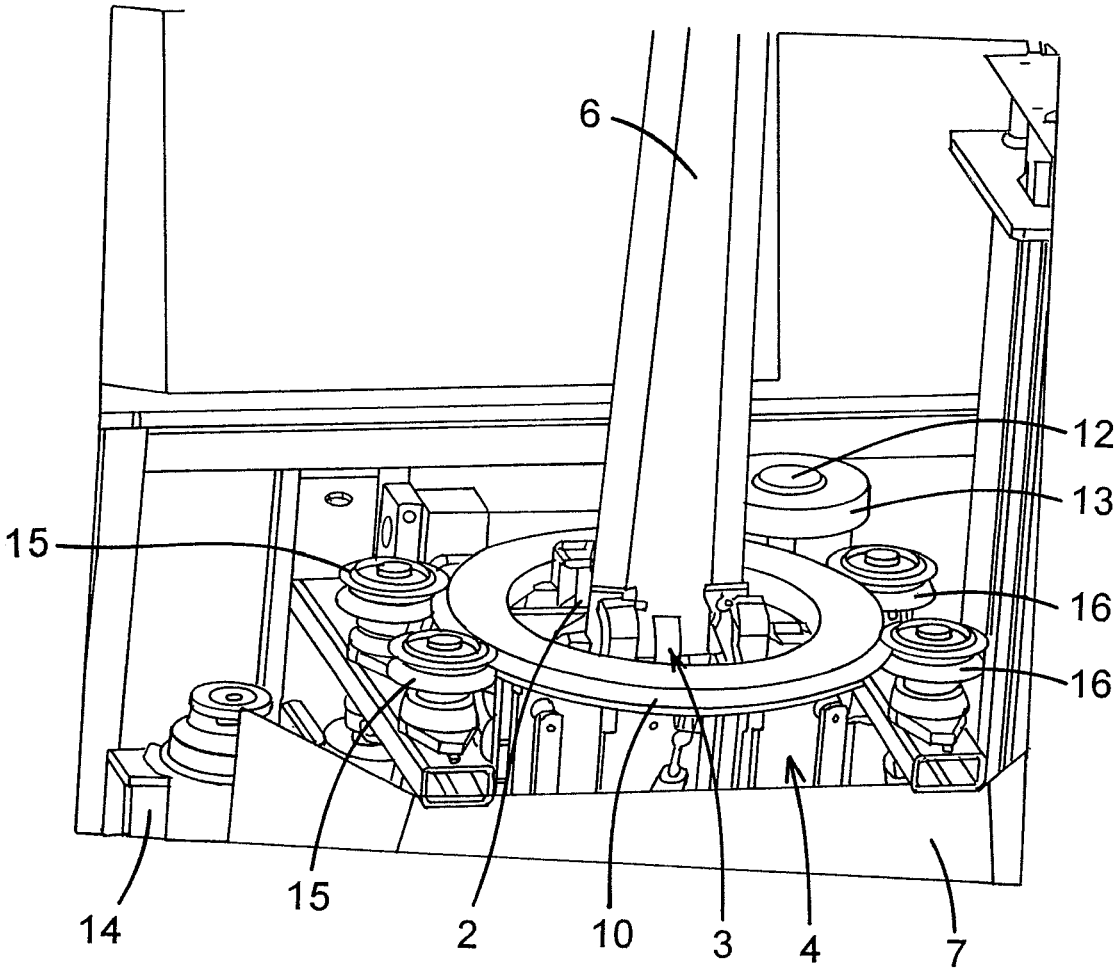
FIG. 3 shows a detailed view of a band winding system according to the invention.

FIG. 3 shows detail of a band winding unit 4, including a guide ring 10 which surrounds the pelting board holder 2 and the grippers 11 of the fur holder 3. The guide ring 10 is connected with a supply reel 12 on which the winding material 13 is wound on and drivingly connected to a motor 14 via driving wheels 15. Rotation of the guide ring 10 is furthermore stabilized with guide rollers 16.

The invention claimed is:

1. A method of securing a fur to a pelting board using an apparatus including a winding unit for wrapping material around the fur, a pelting board holder and fur holder comprising:

retaining the pelting board in the pelting board holder;

placing the fur on the pelting board and securing an end of the fur with the fur holder to stretch the fur to conform the fur to an outer surface of the pelting board; and activating the winding unit to wrap the material under tension around the fur which conforms the fur to the pelting board to retain the fur on the pelting board in a stretched condition after release of the fur holder.

2. A method in accordance with claim 1 wherein the material supplied to the winding unit is wrapped on a supply reel which is braked by a brake to create the tension.

3. A method according to claim 2 comprising winding the material to cause locking of an outer layer of the material to an inner layer of the material while the material is under tension and is stretched.

4. A method according to claim 1, comprising displacing the winding unit longitudinally in relation to the pelting board holder and the pelting board during wrapping of the fur.

5. A method in accordance with claim 4 wherein the winding unit wraps an outer layer of the material over an inner layer of the material while the material is under tension and is stretched.

6. A method apparatus according to claim 5, wherein the fur holder includes grippers for retaining the fur.

7. A method according to claim 4, wherein the fur holder includes grippers for retaining the fur.

8. A method according to claim 1 comprising winding the material to cause locking of an outer layer of the material to an inner layer of the material while the material is under tension and is stretched.

9. An apparatus for securing a fur to a pelting board comprising:

a winding apparatus including a pelting board holder for holding the pelting board during placing of the fur on the pelting board to conform the fur with an outer surface of the pelting board, a fur holder for retaining an end of the fur while the fur is stretched in contact with the outer surface of the pelting board and a winding unit for wrapping material around the fur under tension to retain the stretched fur on the pelting board, and wherein the material which is wrapped around the fur fixes the fur on the pelting board in a stretched condition after the fur is no longer retained by the fur holder.

10. An apparatus according to claim 9, wherein the winding unit includes a supply reel arranged on a guide ring of the winding unit.

11. An apparatus according to claim 10, wherein the supply reel comprises a brake which creates the tension during wrapping of the material around the fur.

12. An apparatus in accordance with claim 9 wherein the winding unit wraps an outer layer of the material over an inner layer of the material while the material is under tension and is stretched.

13. An apparatus according to claim 12, wherein the fur holder includes grippers for retaining the fur.

14. An apparatus according to claim 11, wherein the fur holder includes grippers for retaining the fur.

15. An apparatus in accordance with claim 10 wherein the winding unit wraps an outer layer of the material over an inner layer of the material while the material is under tension and is stretched.

16. An apparatus according to claim 15, wherein the fur holder includes grippers for retaining the fur.

17. An apparatus according to claim 10, wherein the fur holder includes grippers for retaining the fur.

18. An apparatus according to claim 9, wherein the winding unit is longitudinally displaceable in relation to the pelting board holder and pelting board during wrapping of the fur.

19. An apparatus in accordance with claim 18 wherein the winding unit wraps an outer layer of the material over an inner layer of the material while the material is under tension and is stretched.

20. An apparatus according to claim 19, wherein the fur holder includes grippers for retaining the fur.

21. An apparatus according to claim 18, wherein the fur holder includes grippers for retaining the fur.

22. An apparatus according to claim 9, wherein the fur holder includes grippers for retaining the fur.

23. An apparatus in accordance with claim 22 wherein the winding unit wraps an outer layer of the material over an inner layer of the material while the material is under tension and is stretched.

24. An apparatus according to claim 23, wherein the fur holder includes grippers for retaining the fur.

25. An apparatus in accordance with claim 9 wherein the winding unit wraps an outer layer of the material over an inner layer of the material while the material is under tension and is stretched.

26. An apparatus according to claim 25, wherein the fur holder includes grippers for retaining the fur.

* * * * *